US012714244B2

(12) United States Patent
Johnson et al.

(10) Patent No.: US 12,714,244 B2
(45) Date of Patent: Aug. 25, 2026

(54) LASSO-ROPE ORGANIZER SYSTEM AND METHOD

(71) Applicants: Kolby Johnson, Welsh, LA (US); Joseph Johnson, Lake Charles, LA (US)

(72) Inventors: Kolby Johnson, Welsh, LA (US); Joseph Johnson, Lake Charles, LA (US)

( * ) Notice: Subject to any disclaimer, the term of this patent is extended or adjusted under 35 U.S.C. 154(b) by 0 days.

(21) Appl. No.: 18/972,383

(22) Filed: Dec. 6, 2024

(65) Prior Publication Data

US 2026/0157546 A1 Jun. 11, 2026

(51) Int. Cl.
*A47F 7/00* (2006.01)
*A47B 81/00* (2006.01)

(52) U.S. Cl.
CPC ..... *A47F 7/005* (2013.01); *A47B 81/00* (2013.01)

(58) Field of Classification Search
CPC ... A47F 7/005; A47F 7/10; A47F 7/12; A47B 81/00; A47B 81/005
See application file for complete search history.

(56) References Cited

U.S. PATENT DOCUMENTS 1,498,912 A * 6/1924 Henriot ..... A47F 7/12 211/49.1
2,941,672 A * 6/1960 Lathrop ..... A47G 25/02 211/85.3
3,027,130 A 3/1962 Stumpff
3,610,426 A * 10/1971 Thomas ..... A47B 61/003 211/117
4,387,873 A * 6/1983 Pavlo ..... A61M 5/1415 248/231.71
4,654,991 A * 4/1987 Jones ..... A63H 33/40 40/124
4,878,586 A * 11/1989 Bancroft ..... H02G 3/0456 211/106
5,027,960 A 7/1991 Rainville
5,075,932 A 12/1991 Hunt et al.
5,222,701 A 6/1993 Rowland
D377,123 S * 1/1997 Hutchens ..... D8/367
5,794,800 A 8/1998 Carmo et al.
(Continued)

*Primary Examiner* — Stanton L Krycinski
(74) *Attorney, Agent, or Firm* — KEATY LAW FIRM LLC; Thomas S. Keaty

(57) ABSTRACT

A lasso-rope organizer system and method for organizing, storing, and transporting lasso or lariat ropes while avoiding deformation and other damage to the ropes, particularly avoiding deformation of the honda loop, preserving the proper stiffness and other properties of the ropes, providing for any needed drying while avoiding pooling and retention of water, and providing for visibility and easy rapid access to each rope in working, competition, or exhibition circumstances. A base unit is provided which can be mounted upon a substantially vertical structure such as a wall, partition, or post by placing the provided peg hole over a peg, nail, bolt, or similar projecting structure, or by placing a peg through the peg hole and into a receiving hole or socket on the wall, partition, or post. Optionally, a magnet can be provided for mounting the base unit to steel structures. Multiple coil-holder units arrayed vertically upon the base unit provide for removable mounting of coiled ropes such that deformation and damage to the ropes and to the honda loops are avoided.

2 Claims, 3 Drawing Sheets

(56) References Cited

U.S. PATENT DOCUMENTS

| | | | | |
|---|---|---|---|---|
| 5,881,436 | A | 3/1999 | Lyons | |
| 6,345,418 | B1 | 2/2002 | Bertrand et al. | |
| D536,564 | S * | 2/2007 | McGrath | D6/570 |
| 8,132,302 | B2 | 3/2012 | Wilkinson | |
| 8,967,398 | B2 * | 3/2015 | McLemore | F16M 13/02 211/113 |
| 10,501,884 | B2 * | 12/2019 | Uttridge | A47G 25/50 |
| 10,605,381 | B2 * | 3/2020 | Crowe | F16L 3/137 |
| 2007/0102380 | A1 * | 5/2007 | Shaw | A47F 7/0035 211/85.7 |
| 2007/0119881 | A1 * | 5/2007 | Murphy | A47G 25/743 223/97 |
| 2010/0264279 | A1 | 10/2010 | Allen | |

* cited by examiner

LASSO-ROPE ORGANIZER SYSTEM AND METHOD

BACKGROUND OF THE INVENTION

This invention provides a lasso-rope organizer system and method for organizing, storing, and transporting lasso or lariat ropes while avoiding deformation and other damage to the ropes.

A lasso or lariat is a restraining rope which is thrown around an animal and is then tightened by pulling, which restrains the animal. This is an essential skill for working vaqueros or cowboys which has become an important part of rodeo competitions and exhibitions. Ropes for lassos are specially selected and prepared to provide for throwing, for the loop staying open until pulled tight, and for other considerations. A variety of materials, diameters, and lengths of rope are used for different circumstances and conditions. The honda or loop at the end of the rope is of special importance. The honda loop is formed and treated so that it stays open and stays in a specific fixed axial orientation to the rope so that the larger loop of rope can move freely through the honda loop.

Both for working and for rodeo competition the riders are called upon to transport their horses, saddles, and equipment, including usually several lasso ropes, to various locations. In the course of work or a rodeo a rider might need to change from one lasso to another to meet changing conditions or circumstances. If lasso ropes are stored and transported loosely, they often end up on the floor of a barn or trailer where they are subject to being damaged such as a twisting or other deformation of the honda loop, which can render the whole lasso useless. Existing storage and transport solutions such as bags or carriers fail to protect the lasso ropes fail to adequately protect the ropes from deformation and damage, such as pressure from a stack of ropes upon the lowest ropes in the stack. Also, ropes spread around loosely on the floor or stacked in a bag or carrier can be difficult to locate in a timely manner.

What is needed is a lasso-rope organizer for organizing, storing, and transporting lasso or lariat ropes while avoiding deformation and other damage to the ropes, particularly avoiding deformation of the honda loop.

U.S. Pat. No. 5,027,960 for a "Hanger Strap," issued on Jul. 2, 1991 to inventor Nancy A. Rainville, provides for a rack for storing elongated articles, where the rack is formed of flexible nylon webbing and a number of clasp-like connectors. A main support strap bears the weight of all the stored items, which are individually secured to the main support strap by loops formed by joining the free ends of lengths of webbing, the opposite ends of which are affixed to the main support strap. The hanger straps of the present invention do not need to be connected to a wall, but instead can be suspended from any point on the ceiling. When not in use, the hanger straps can be rolled up into a compact pack for storage or shipment.

U.S. Pat. No. 5,075,932 for a "Cord Holder," issued on Dec. 31, 1991 to inventors Richard C. Hunt et al., provides for a strap device for retaining in coiled condition of a coiled length of slender flexible material, such as an electrical extension cord, and for hanging it for storage, where the device comprises a length of flexible strap material attached to a buckle formed to receive opposite end portions of the strap such that a relatively large loop can be provided by one of the end portions of the strap to encircle the coiled length and a relatively small loop can be provided at a doubled back-on-itself part of the other of the end portions of the strap to receive and retain an end portion of the coiled length, a cinch slide member being variously provided for closing the loop tightly about such received end portion of the coiled length, and a suspension-hook-receiving member being provided in preferably the end portion of the strap that provides the relatively small loop.

U.S. Pat. No. 6,345,418 for a "Rope Hook," issued on Feb. 12, 2002 to assignee Metolius Mountain Products, Inc., provides for a rope hook that comprises a length of tubular fabric webbing into which a pair of loops has been formed. The first loop serves to attach the hook to an object. A resilient U-shaped member is contained within the tubular webbing to define a U-shaped member for holding a coil of rope. An adjustable fastener spans the opening into the hook for engagement with the second loop.

U.S. Pat. No. 5,881,436 for a "Portable Line Harnessing Device," issued on Mar. 16, 1999 to inventor Thomas B. Lyons, provides for a portable harnessing device to maintain chorded lines, such as ropes, electrical cords, etc., in an orderly, untangled, coiled line bundle arrangement. The harnessing device includes a flexible strap (such as a leather, woven fabric, etc.) fitted with an adjustable buckling assembly which may be looped about and adjustably sized so as to tautly harness a variety of different coiled line bundle sizes. Unbuckling the buckling assembly unharnesses the coiled line bundle so as to permit its removal from the harnessing strap. The device is equipped with an auxiliary harness which permits separate harnessing of a segmented portion of the line from the main coiled line bundle.

US Publication No. 2010/0264279 for a "Cable Organizer, Storage and Porting Utility," published on Oct. 21, 2010 by inventor Don Allen, discloses a cable caddie for organizing, storing, and porting cables, where the caddie is made from a durable flexible fiber strap piece between 3 and 6 feet long forming the base layer, a terminal or handle coupled to at least one end of the strap, and at least one Velcro strip piece with one end of the strip piece coupled on to the flexible strap base layer and the distal end having the mating Velcro fiber forming a loop when mated when the distal end is folded upon the coupled end. Wrapped or wound cable are held in the Velcro strip loop formed when the strip is folded over the wrapped cable loops and onto the mating Velcro side securing the cable loop to the base layer. Several such Velcro strips for easy looping about and securing the cables to the base strap carrier, can provide organization and allow easy porting of many cables, as the base strap can be rolled up and carried by the handles attached.

U.S. Pat. No. 8,132,302 for a "Cord Organizer," issued on Mar. 13, 2012 to inventor Charles Ervin Wilkinson, provides for an organizer device having a primary back strap, the primary back strap having a first end, a second end, and a middle portion. The first end having a first buckle portion and a means for suspending the back strap, the second end having a second buckle portion, the middle portion having at least one attachment location with an appended buckle portion interposed between the first and second ends; and wherein the second end is provided to receive the first end of a second primary back strap. The device further has at least one removable cinch strap device having a first end and a second end, the first end having two buckle portions, a first buckle portion for removable attachment to the attachment location with an appended buckle on the primary back strap and a second buckle portion to attach to the buckle portion at the second end of the cinch strap to form a loop for holding a coil of cable, a power tool box or other material.

U.S. Pat. No. 5,222,701 for a "Wall Mounted Support for Holding Articles," issued on Jun. 29, 1993 to inventor David E. Rowland, provides for a support that may be used to hold articles and which may be removably attached to a base that is mounted on a wall. The device has two main parts: a base that may be mounted on a wall and a plug-in device that may be inserted into or removed from the base. The base defines a cavity for receiving one end of the plug-in device. One wall of the cavity is a resilient arm the free end of which enters an indent in the plug-in device to provide some impedance to the removal of the plug-in device from the cavity. A cam or wedge may be used to firmly secure the arm in the indent and thus secure the plug-in device in the cavity. The plug-in device has two free ends each with a socket. A resilient cord, with spaced enlargements, extends between the free ends of the plug-in device and holds an article, such as a coil of wire or a broom handle, against the plug-in device.

U.S. Pat. No. 3,027,130 for a "Quick Release Rope Holder," issued on Mar. 27, 1962 to inventor Clarence R. Stumpff, provides for a rope holder for releasably securing a rope or lariat to a saddle.

U.S. Pat. No. 5,794,800 for a "Display Strap for Elongated Articles Formed Into Hanks," issued on Aug. 18, 1998 to assignee Leviton Manufacturing Co., Inc., provides for a display strap in the form of a flat belt of flexible material into which a number of tongues are cut each individually deflectable out of the plane of the strap about an unsevered end used as a hinge. The tongue has a cross-member at its free end and a portion of reduced width adjacent the cross-member. Two part slots are provided adjacent the hinge to receive the cross-member and then permit the tongue to be displaced into locking engagement between the cross-member and the rear surface of the strap. The looped tongue is employed to support elongate articles formed into multi-turn hanks. An alternative locking slot arrangement employs a tapered width locking slot which requires the tongue to be rotated to enter the locking slot making accidental opening of the loop very difficult.

SUMMARY OF THE INVENTION

This invention provides a lasso-rope organizer system and method for organizing, storing, and transporting lasso or lariat ropes while avoiding deformation and other damage to the ropes, particularly avoiding deformation of the honda loop, preserving the proper stiffness and other properties of the ropes, providing for any needed drying while avoiding pooling and retention of water, and providing for visibility and easy rapid access to each rope in working, competition, or exhibition circumstances. A base unit is provided which can be mounted upon a substantially vertical structure such as a wall, partition, or post by placing the provided peg hole over a peg, nail, bolt, or similar projecting structure, or by placing a peg through the peg hole and into a receiving hole or socket on the wall, partition, or post. Optionally, a magnet can be provided for mounting the base unit to steel structures. Multiple coil-holder units arrayed vertically upon the base unit provide for removable mounting of coiled ropes such that deformation and damage to the ropes and to the honda loops are avoided.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
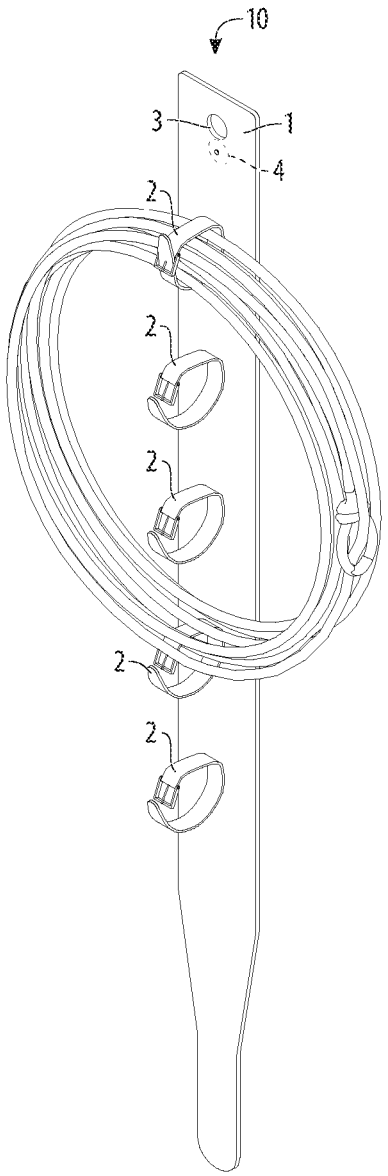
FIG. 1 is a perspective view of the lasso-rope organizer of the invention in use with one lasso rope.

Referring to FIG. 1, the lasso-rope organizer 10 system and method provides for organizing, storing, and transporting lasso or lariat ropes while avoiding deformation and other damage to the ropes, particularly avoiding deformation of the honda loop, preserving the proper stiffness and other properties of the ropes, providing for any needed drying while avoiding pooling and retention of water, and providing for visibility and easy rapid access to each rope in working, competition, or exhibition circumstances.

Figure 2:
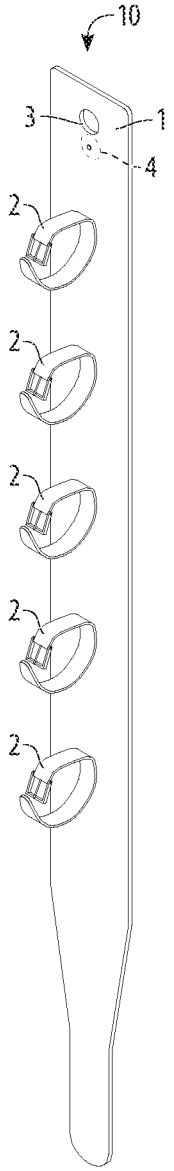
FIG. 2 is a perspective view of the lasso-rope organizer of the invention.
Figure 3:
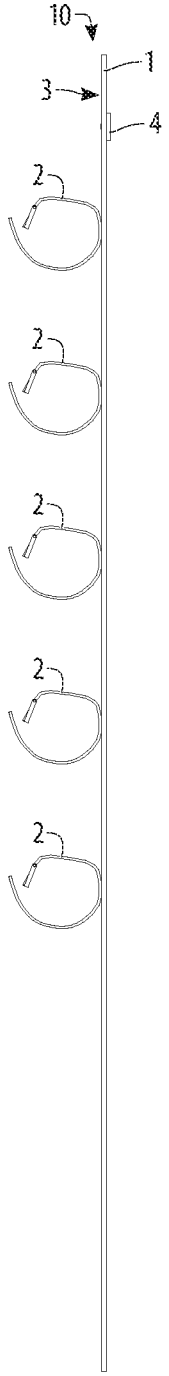
FIG. 3 is a side view of the lasso-rope organizer of the invention.
Figure 4:
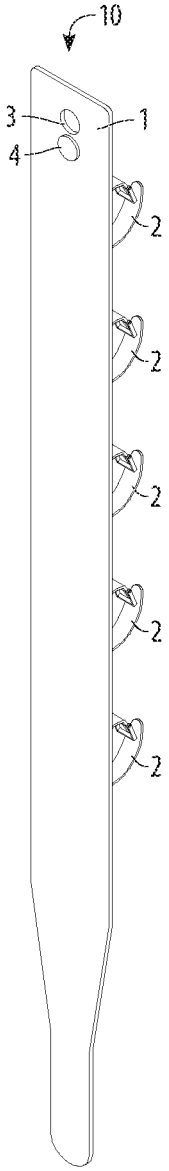
FIG. 4 is a rear perspective view of the lasso-rope organizer of the invention.

Referring additionally to FIG. 2, FIG. 3, and FIG. 4, the lasso-rope organizer 10 provides a base unit 1 having a vertical top-to-bottom orientation. In the illustrated preferred embodiment, the base unit 1 is made of leather or similar material, providing a combination of stiffness and flexibility, and compatibility with saddles and other equipment used in the work, competition, or exhibition. The base unit 1 can be mounted upon a substantially vertical structure such as a wall, partition, or post by placing the provided peg hole 3 over a peg, nail, bolt, or similar projecting structure, or by placing a peg through the peg hole 3 and into a receiving hole or socket on the wall, partition, or post. Optionally, a magnet 4 can be provided to facilitate direct attachment to steel structures such as steel walls of a trailer or a building or to a steel post. The lasso-rope organizer 10 and all of the attached ropes can be moved, for instance, from a barn or storeroom to a trailer, and then to a staging area of an arena without risk of damaging or misplacing any of the ropes.

Multiple coil-holder units 2 are mounted in a vertical array upon the base unit 1, as shown. In the illustrated preferred embodiment, each coil-holder unit 2 is a leather strap with a buckle or similar fastening device.

Figure 5:
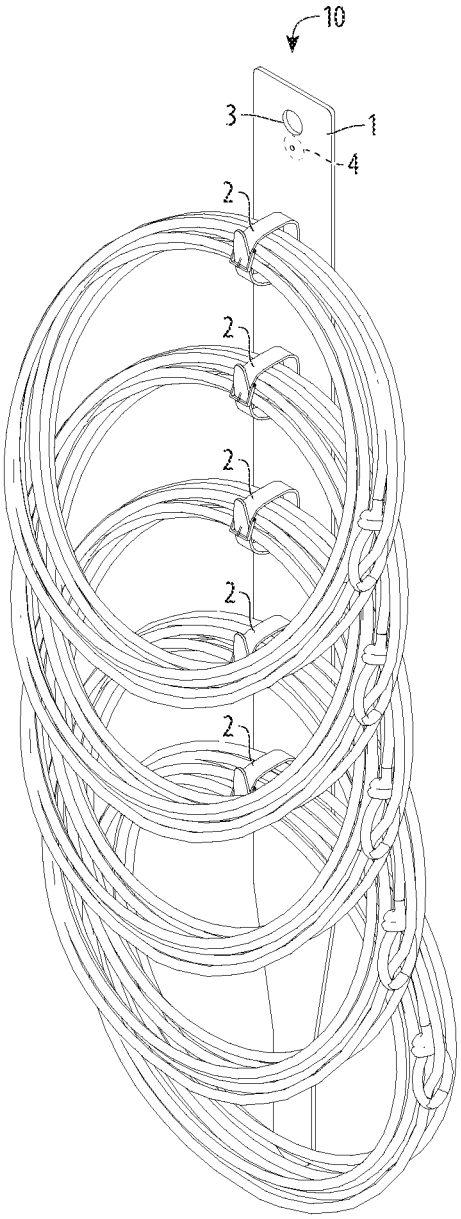
FIG. 5 is a perspective view of the lasso-rope organizer of the invention in use with multiple lasso ropes.
Figure 6:
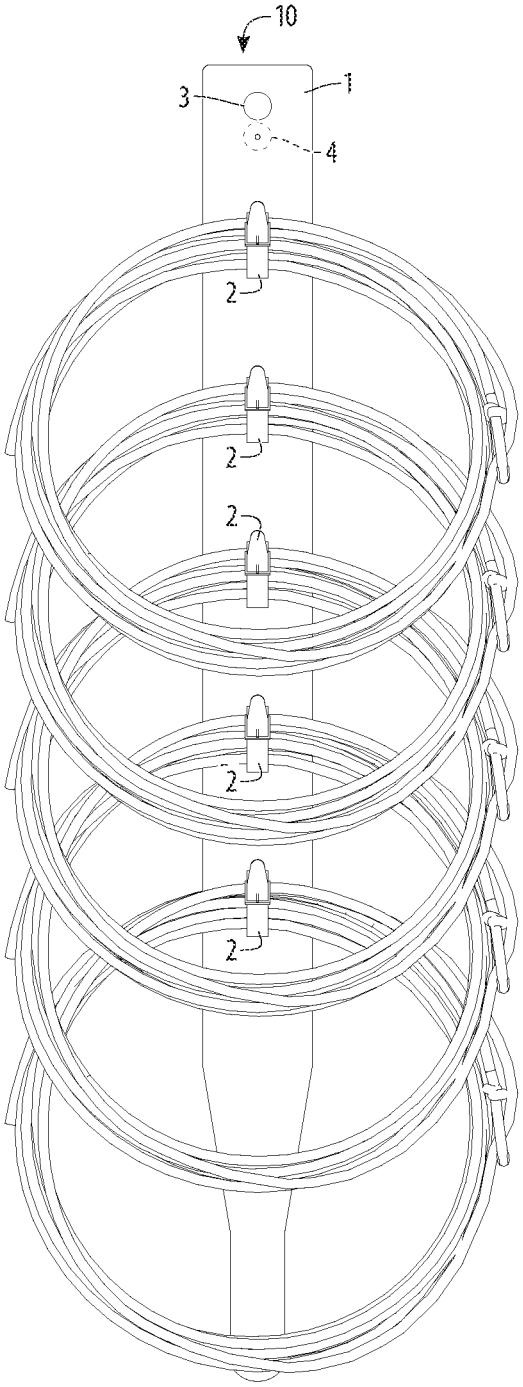
FIG. 6 is a front view of the lasso-rope organizer of the invention in use with multiple lasso ropes.

Referring to FIG. 5 and FIG. 6, in use, a coiled lasso rope is removably mounted into a coil-holder unit 2, and other coiled lasso ropes are mounted into other coil-holder units 2. The coiled ropes are held such that they overlap each other but are separate from each other, allowing all ropes to be quickly seen and be quickly accessed when needed. Each coiled rope is held such that no strain or deforming force is placed on the honda loop of any rope, preserving the important properties of the honda loops.

The lasso-rope organizer 10 system and method allows, for example, several coiled lasso ropes having various lengths, diameters, and other properties to be safely stored in a barn or shed while remaining available for inspection, treatment, and repair, allows for those several coiled ropes to be moved into and mounted in a trailer without risk of damage or misplacement, and allows for those several coiled ropes to be either left in the trailer or be moved into a staging area of an arena, and all the time avoiding deformation or damage while keeping the several coiled ropes visible and accessible for use or for needed substitutions.

Many other changes and modifications can be made in the system and method of the present invention without departing from the spirit thereof. We therefore pray that our rights to the present invention be limited only by the scope of the appended claims.

We claim:

1. A lasso-rope organizer system for lasso ropes having honda loops, the lasso-rope organizer system comprising:

(i) a base unit having a vertical top-to-bottom orientation;

(ii) a plurality of coil-holder units arrayed vertically upon said base unit, each coil-holder unit comprises a leather strap with a buckle, the leather strap being configured to encircle and support a coiled lasso rope without deforming the honda loop;

(iii) a peg hole through said base unit near the top, configured to receive a peg for removable mounting of said base unit to a substantially vertical structure; and (iv) a mounting magnet disposed on an exterior surface of said base unit, the mounting magnet configured to removably attach the base unit to a steel structure.

2. The lasso-rope organizer system of claim 1, where said base unit comprises a leather body providing a combination of stiffness and flexibility sufficient to maintain a vertical top-to-bottom orientation and support multiple coil-holder units and coiled lasso ropes without deformation.

* * * * *